US006946933B2

(12) United States Patent
Accatino et al.

(10) Patent No.: US 6,946,933 B2
(45) Date of Patent: Sep. 20, 2005

(54) DIELECTRIC LOADED CAVITY FOR HIGH FREQUENCY FILTERS

(75) Inventors: Luciano Accatino, Turin (IT); Giorgio Bertin, Turin (IT); Mauro Mongiardo, Turin (IT)

(73) Assignee: Telecom Italia Lab S.p.A., Turin (IT)

( * ) Notice: Subject to any disclaimer, the term of this patent is extended or adjusted under 35 U.S.C. 154(b) by 75 days.

(21) Appl. No.: 10/333,621

(22) PCT Filed: Jul. 18, 2001

(86) PCT No.: PCT/EP01/08289

§ 371 (c)(1),
(2), (4) Date: Jan. 17, 2003

(87) PCT Pub. No.: WO02/09228

PCT Pub. Date: Jan. 31, 2002

(65) Prior Publication Data

US 2003/0151473 A1 Aug. 14, 2003

(30) Foreign Application Priority Data

Jul. 20, 2000 (IT) ..... TO2000A0716

(51) Int. Cl.[7] ..... H01P 1/20; H01P 7/06

(52) U.S. Cl. ..... 333/202; 333/227; 333/230; 333/232; 333/219.1

(58) Field of Search ..... 333/219.1, 202, 333/227, 230, 232, 234, 231, 212, 208

(56) References Cited

U.S. PATENT DOCUMENTS 4,453,146 A 6/1984 Fiedziuszko
4,675,630 A * 6/1987 Tang et al. ..... 333/208
4,706,052 A * 11/1987 Hattori et al. ..... 333/219.1
5,008,640 A 4/1991 Accatino et al.
5,059,929 A 10/1991 Tanaka

FOREIGN PATENT DOCUMENTS

| | | |
|---|---|---|
| EP | 0 351 840 | 1/1990 |
| EP | WO 99/19933 | 4/1999 |
| EP | 0 961 338 | 12/1999 |
| JP | 05327324 | 12/1993 |
| JP | 61136302 | 6/1996 |

OTHER PUBLICATIONS

Design and Realization of a Four Pole Elliptic Microwave Filter . . . published Aug. 6, 1997 IEEE.

Tunable, Temperature–Compensated Dielectric Resonators and Filters, published IEEE 38(Aug. 8, 1990.

* cited by examiner

*Primary Examiner*—Robert Pascal
*Assistant Examiner*—Kimberly Glenn
(74) *Attorney, Agent, or Firm*—Herbert Dubno

(57) ABSTRACT

The dielectric loaded cavity for high frequency filters consists of a metal container housing s dielectric block held in position by supporting plates, that also sustains coupling and tuning elements. This invention provides broadband filters, small in size and with low losses. Its high symmetry structure considerably reduces the energizing of spurious modes and furthermore facilitates the design using automatic calculation procedures, on the basis of accurate electromagnetic models.

11 Claims, 3 Drawing Sheets

DIELECTRIC LOADED CAVITY FOR HIGH FREQUENCY FILTERS

CROSS REFERENCE TO RELATED APPLICATIONS

This application is a national stage of PCT/EP01/08289 filed 18 Jul. 2001 and is based upon Italian national application TO2000A000716 of 20 Jul. 2000 under the International Convention.

FIELD OF THE INVENTION

This invention refers to devices for telecommunication systems and in more particularly to a dielectric-loaded cavity for high frequency filters.

BACKGROUND OF THE INVENTION

In telecommunication systems for civilian use, with special reference to mobile telephones, there is a problem of providing microwave filters that, placed along a transmission line, allow the is separation of different band or frequency channels; for example, separating transmission channels from receiving channels.

Usually these filters are implemented with a plurality of cavities in cascade and are mutually coupled through irises, screws or the like. As is known, these cavities, which may be of the waveguide type with a cylindrical or prismatic shape, or of the co-axial type, with an internal metal conductor, are of a size that depends on the wavelength of the signal to be filtered, therefore the filter obtained may be quite large, especially at lower frequencies (1–4 GHz), and as a consequence the resulting overall dimensions may be excessive.

This problem becomes more critical when the telecommunications system development is such as to make a considerable number of these filters necessary, especially when these are fitted near aerials, often installed on the roofs of civil buildings.

One method of reducing the size of these filters, which has become common in recent years, is to insert a block of dielectric material into each cavity.

Because of the high permittivity of the material introduced into the resonator, the electromagnetic field remains mainly concentrated inside, and thus the dimensions of the cavity, calculated to obtain the resonance at a certain wavelength, are considerably reduced. In fact, the dimensions of an equivalent filter with dielectric-loaded resonators are reduced from between one third to one sixth of the original volume. The electrical characteristics of the filter are not excessively penalized, because of the availability of low loss, high temperature-stability ceramic materials.

Another method of obtaining small sized filters is to reduce the number of cavities used, exploiting two or more resonant modes in each cavity by means of the re-use technique, which permits the design of dual mode or triple mode resonators. The coupling between the modes is obtained by perturbing the cavity section in the diagonal plane in relation to the polarization planes of the modes themselves. The effect that results is the same as that which can be obtained with two ordinary cavities, thus a filter with a desired band can be obtained with half the number of cavities.

Moreover, the re-use of the same cavity also permits more sophisticated transfer functions than transfer functions with all the infinite or polynomial transmission zeroes, characteristic of a cavity plurality simply connected in cascade.

One of the problems found in the preparation of filters that use cavities of the type mentioned, is the difficulty in obtaining couplings with a sufficiently high value, especially when the band pass required is comparatively wide, e.g. more than one percent of the central frequency.

It is a known fact that cavity couplings are obtained by the introduction of mechanical elements, such as probes or screws, the latter also permitting the tuning of the same. Obviously, if the cavity contains dielectric material inside, there are further difficulties in the arrangement of these elements. In fact, the dielectric material, on one hand makes stronger the internal electromagnetic field, limiting the peripheral field that intervenes in the couplings, on the other hand it mechanically limits the penetration of the screws and probes.

The problem becomes worse due to the fact that all these elements are to be preferably located on the plane which is perpendicular to the rotation axis of the dielectric material and divides it into two equal parts: in fact, in this way the operation is carried out where there is a high electromagnetic field, obtaining a coupling of a greater value, and the energizing of spurious resonating modes is avoided, which could generate anomalous responses in the operating band.

Furthermore, when the filter is designed to function at very low frequencies, for example between 1 and 4 GHz, where the wavelength, and therefore also the size of the cavity, is greater, the cavity internal volume has to be occupied as much as possible by the dielectric material, so as to obtain the maximum reduction in the overall dimensions. As a consequence, the space to house screws and probes is further limited.

Among the dielectric loaded cavities known at present, is that described in U.S. Pat. No. 5,008,640, issued in the United States on Apr. 6, 1991, entitled "Dielectric-loaded cavity resonator", in the name of the present applicant, which solves the problem arising from the dimensions and has low losses in the pass band. However, it is not suitable for broadband filters, which require very tight couplings between resonators and therefore considerable penetration of the coupling elements in the dielectric resonator transverse symmetry plane.

Another known cavity is that described in WO 99/19933 published on Apr. 22, 1999, in the name of Filtronic PLC, entitled "Composite resonator". In the resonator described, the dielectric element rests on the base of the metal cavity and has a metal disk on the summit. This configuration permits a considerable reduction in the presence of spurious modes in the vicinity of the filter operating frequency, but increases the resonator losses. Further-more, to obtain the required couplings, certain mechanical devices are necessary, such as plates and disks with a rather critical adjustment.

OBJECT OF THE INVENTION

It is the object of the invention to provide a dielectric-loaded cavity for high frequency filters which avoids these difficulties and solves the technical problems described, permitting the realization of broadband filters, maintaining small dimensions and low losses. The high symmetry of the cavity of the invention structure permits considerable reduction in the energizing of spurious modes and moreover facilitates the design, using automatic calculation procedures thanks to the availability of accurate electromagnetic models.

SUMMARY OF THE INVENTION

This invention provides a dielectric loaded cavity for high frequency filters which consists of a metal container, divided transversally into two parts, mutually secured, a dielectric block, of a high permittivity material able to load the cavity and reduce the operating frequency; supporting plates to hold the dielectric block in place inside the metal container; and coupling and tuning elements. The dielectric block includes a groove lying in a transverse plane and extending over the entire perimeter of the block.

The groove in the dielectric block can have a depth such as to divide the original block into two coplanar blocks of lesser height. A further supporting plate can be interposed between the two coplanar blocks. The 4 supporting plates can be of a plastic or ceramic low permittivity, low loss dielectric material.

The groove of the dielectric block lies in a plane which intersects the coupling and tuning elements, fastened to the metal container.

The dielectric block can be of cylindrical shape and the metal container, transversally divided into two parts can be cylindrical in shape.

A first screw can be placed at 180° to a probe to tune a first resonant mode, a second screw can be placed at a right angle to the first screw to tune a second resonant mode and a third screw can be placed at 45° to the first and the second screw to couple the first and second resonant modes. A probe can be in a position that is not symmetrical in relation to either one of a first and a second tuning screw. The cavity can be fitted with an iris, in a base of the metal container, for coupling to other cavities. The cavity can have an opening in a side part of the metal container for coupling to other cavities. The cavity can also have a probe that is fastened to the side wall of the metal container, for coupling to other cavities.

BRIEF DESCRIPTION OF THE DRAWING

The foregoing and other characteristics of this invention will be made clearer by the following description of some preferred forms of the invention, given by way of non-limiting example, and by the annexed drawings in which.

SPECIFIC DESCRIPTION

Figure 1:
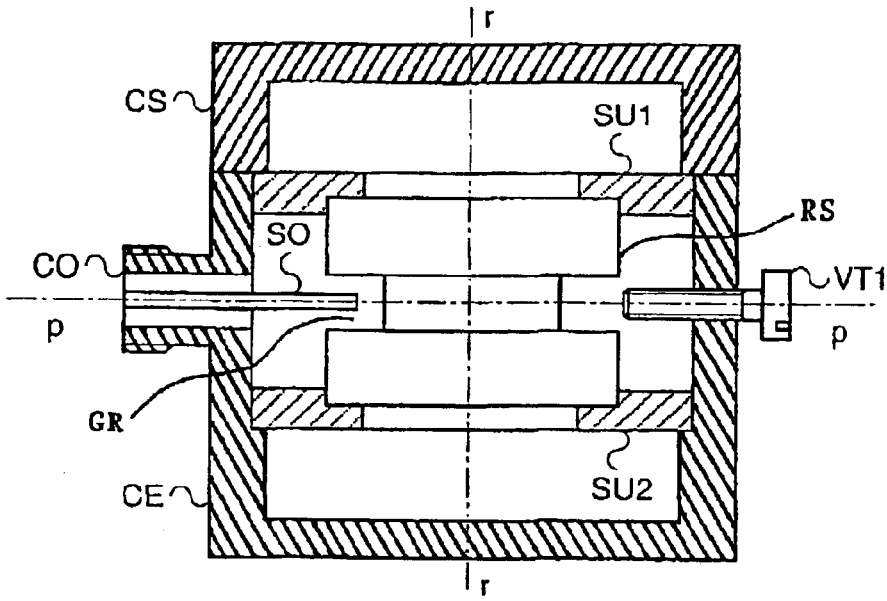
FIG. 1 is a longitudinal section of the cavity.

The cavity illustrated in FIG. 1 consists of a metal container CE, CS in which a proper cylindrical cavity with a rotation axis r—r has been obtained, and a cylindrical block RS of dielectric material held in position by a pair of supporting plates SU1 and SU2, so as to render the whole mechanically stable without the use of adhesives. In FIG. 1, the block RS is not shown in section.

The dielectric material of block RS is of high permittivity, so as to load the cavity, reducing the operating frequency, and the block includes a groove GR on a plane p—p transversal to the rotation axis r—r, the groove extending over the entire circumference. More precisely, plane p—p coincides with an electrical symmetry plane of the cavity, but not necessarily with a geometric symmetry plane, and also contains the various coupling and tuning elements fastened to the metal container.

The dielectric cylindrical block RS is held in a coaxial position with the cavity by two supporting washer-shaped plates SU1 and SU2, each of which has an axial hole to cut down losses and a centering bottom that houses one of the bases of the grooved cylindrical block RS.

The cylindrical metal container is divided crosswise to the rotation axis r—r into two parts, CE and CS, which are mutually fixed by screws. The part indicated by CE houses the group composed of the supporting plates SU1 and SU2 and block RS.

The inner diameter of the cavity is slightly enlarged to contain this group in CE and the group is held at a suitable distance from the bottom by a step that is created by a difference of two diameters of part CE. The depth of the cavity section with the greater diameter is advantageously made equal to the height of the group of the supporting plates and the grooved cylindrical block. In this way it is sufficient to prepare part CS with a slightly smaller diameter than that of the supporting plates to hold the whole group firmly in position.

Coupling and tuning elements are fitted in part CE of the metal container, corresponding to the electric symmetry plane p—p, i.e.: a probe SO, connected to a coaxial connector CO, that couples the cavity to a generator or an external load, and a plurality of metal screws VT1, VT2, VT3, . . . , to obtain both coupling between resonant modes inside the cavity, and the tuning of the same. Probe SO and screws VT1, VT2, VT3 can penetrate into the groove GR of cylindrical block RS to the depth required to obtain the desired coupling and tuning effects.

Figure 2:
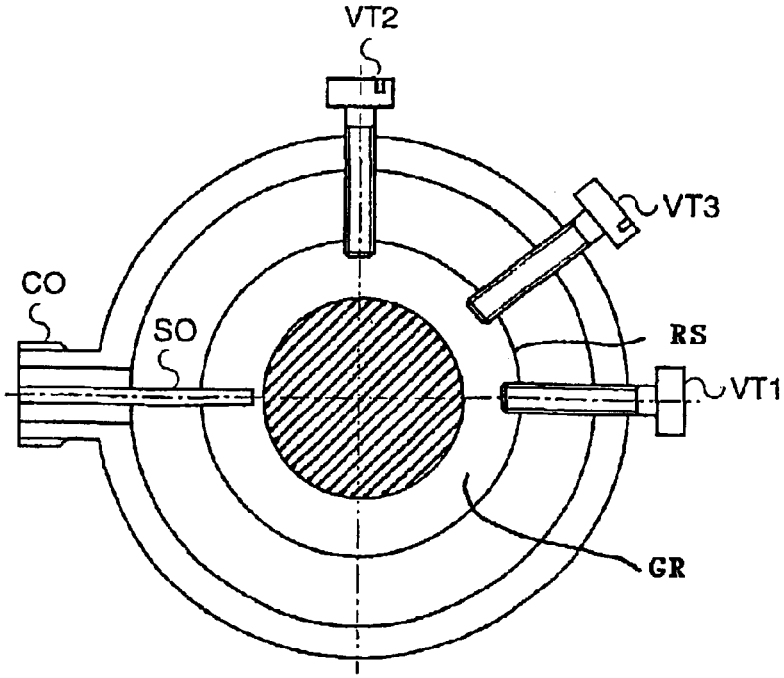
FIG. 2 is a cross section of the same cavity as in FIG. 1.

FIG. 2 illustrates the angular arrangement of the probe and the screws that permits a conventional dual-mode functioning of the cavity.

The first resonant mode, energized by probe SO, is tuned by screw VT1, angled at 180:: to the probe. Screw VT2, which is at a right-angle to VT1, tunes the second resonant mode, coupled to the first by screw VT3, which is angled at 45:: to VT1 and VT2.

Figure 3:
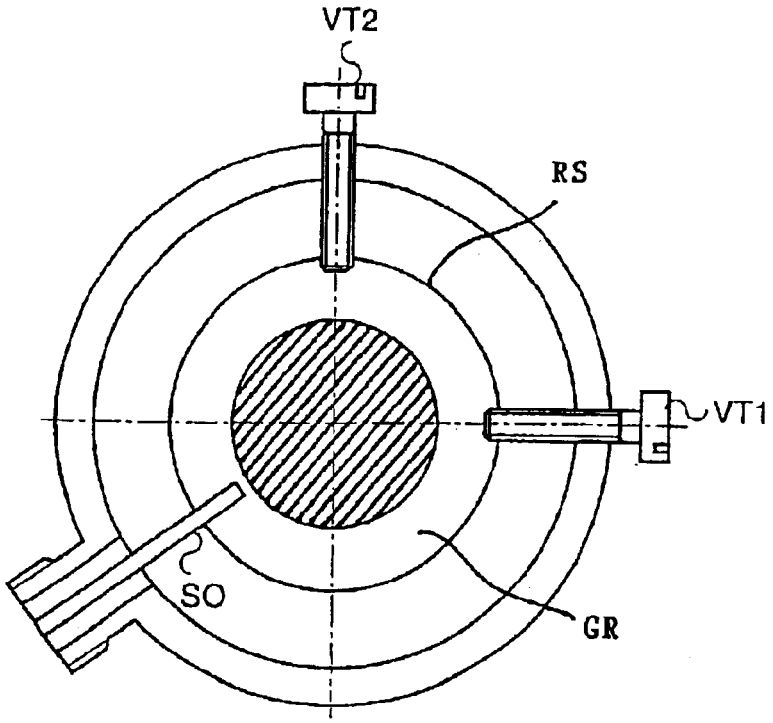
FIG. 3 is a cross section of a second cavity form.

FIG. 3 highlights another angular arrangement of the probe and the screws, to obtain a different cavity dual-mode functioning. In this case, probe SO is not symmetrical to either one of the two tuning screws VT1 and VT2, which are at 90:: to each other. Probe SO generates the coupling to the generator or the external load of both resonant modes tuned by VT1 and VT2. Another screw, not shown in the figure, could be set at 45:: to VT1 and VT2 to further mutually couple the two resonant modes.

Figure 4:
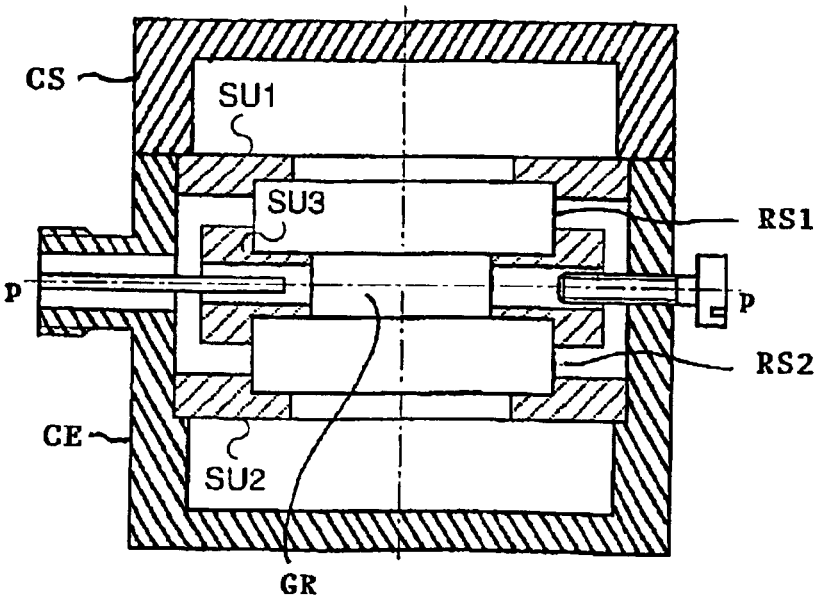
FIG. 4 is a longitudinal section of a third cavity form.

FIG. 4 shows an extreme case in which the groove GR in the cylindrical block RS has the same depth as the radius; thus the original cylinder divides into two coplanar cylinders RS1 and RS2 of lesser height. In this case, it is necessary to interpose another supporting plate SU3 to keep the two cylinders RS1 and RS2 at the required distance, SU3 having radial through-holes for the coupling and tuning elements.

The supporting plates SU1, SU2 and SU3, shown in this figure and the previous ones, are made of a low permittivity, low loss plastic or ceramic dielectric material.

The groove, and in the extreme case, the separation of the dielectric cylindrical block into two cylinders, allows the coupling and tuning elements to penetrate deeply into the regions of the cavity, where the electromagnetic field is more intense. In this way higher coupling values and more extended tuning ranges can be obtained, facilitating the realization of filters with relatively higher percentage bands, for example, over 1% of the central frequency.

The structure of the cavity described allows an easy coupling between similar cavities to obtain band-pass filters of various complexities.

Figure 5:
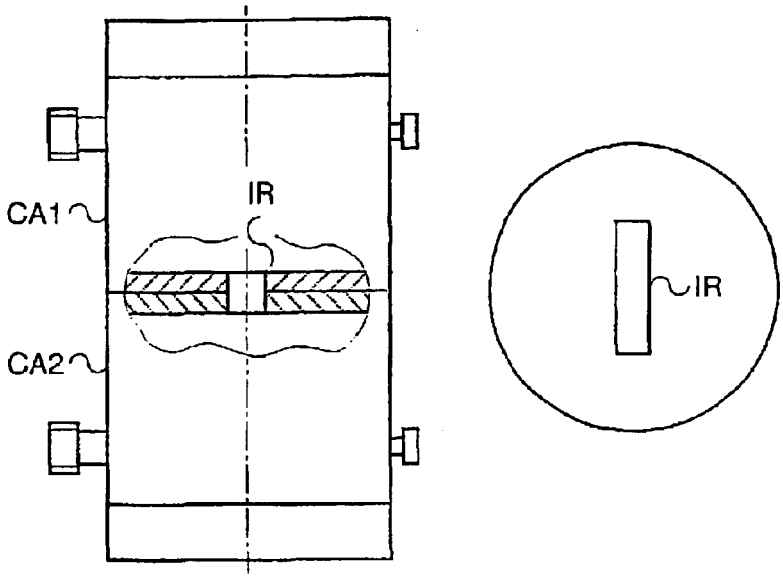
FIG. 5 is a partial section of two cavities overlaid and coupled through the bases.

FIG. 5 shows two cavities CAI and CA2 coaxially overlaid and with a common base. The coupling takes place through an iris IR, usually rectangular in shape, provided in the base itself.

Figure 6:
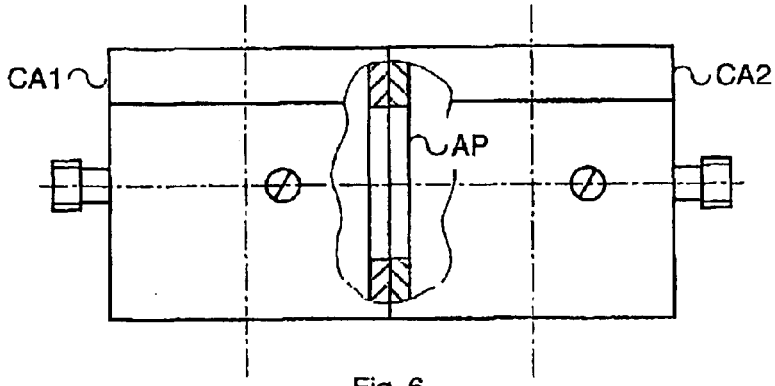
FIG. 6 is a partial section of two cavities side by side, coupled through the side surface.
Figure 7:
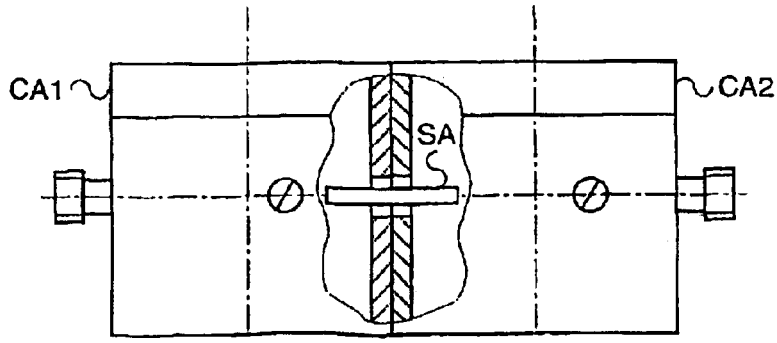
FIG. 7 is a partial section of two cavities side by side, coupled through the side surface in a different manner.

FIGS. 6 and 7 illustrate two cavities, CA1 and CA2, side by side and coupled either through an opening AP in the adjacent side walls, or by a probe SA, that extends in the two cavities through the side walls.

Obviously this description is given as a non-limiting example. Variants and modifications are possible, without emerging from the protection field of the claims.

For example, both the cavity and the dielectric block may be prismatic instead of cylindrical and the groove may be in a position that is not intermediate as shown in the figure, but closer to one end of the dielectric block.

What is claimed is:

1. A dielectric loaded cavity for a high frequency filter, comprising:

a metal container divided transversally into to parts which are together;

a dielectric block of a high permittivity material loading the cavity and reducing an operating frequency thereat;

a plurality of supporting plates in said cavity to hold the dielectric block in place inside the metal container; and a plurality of coupling and tuning elements fastened to the metal container, extending into an interior of the container and intersected by a transverse plane, said dielectric block having a groove extending over an entire perimeter of the block and lying in said transverse plane which intersects said coupling and tuning elements.

2. The dielectric loaded cavity defined in claim 1, wherein said groove in the dielectric block has a depth such as to divide the block into two coplanar blocks of lesser height.

3. The dielectric loaded cavity defined in claim 2, wherein a further supporting plate is interposed between the two coplanar blocks.

4. The dielectric loaded cavity defined in claim 1 wherein said supporting plates are of a plastic or ceramic low permittivity, low loss dielectric material.

5. The dielectric loaded cavity defined in claim 1 wherein said dielectric block is cylindrical in shape.

6. The dielectric loaded cavity defined in claim 1 wherein said metal container, transversally divided into two parts is cylindrical in shape.

7. The dielectric loaded cavity defined in claim 1 wherein a first screw is located at 180° to a probe to tune a first resonant mode, a second screw is located at a right angle to the first screw to tune a second resonant mode and a third screw is located at 45° to the first and the second screw, to couple the first and second resonant modes.

8. The dielectric loaded cavity defined in claim 1 wherein a probe is in a position that is not symmetrical in relation to either one of the said first and second tuning screws.

9. The dielectric loaded cavity defined in claim 1 which is fitted with an iris, in a base of the metal container, for coupling to other cavities.

10. The dielectric loaded cavity defined in claim 1 which has an opening, in the side part of the metal container, for coupling to other cavities.

11. The dielectric loaded cavity defined in claim 1 which has a probe that is fastened to the side wall of the metal container, for coupling to other cavities.

* * * * *